United States Patent [19]

Miram et al.

[11] 4,321,505

[45] Mar. 23, 1982

[54] ZERO-BIAS GRIDDED GUN

[75] Inventors: George V. Miram, Atherton; Gerhard B. Kuehne, Santa Clara, both of Calif.

[73] Assignee: Varian Associates, Inc., Palo Alto, Calif.

[21] Appl. No.: 140,073

[22] Filed: Apr. 14, 1980

Related U.S. Application Data

[62] Division of Ser. No. 927,087, Jul. 24, 1978, Pat. No. 4,227,116.

[51] Int. Cl.[3] ..... H01J 29/46

[52] U.S. Cl. ..... 313/447; 313/454; 313/348; 315/3.5

[58] Field of Search ..... 313/348, 447, 448, 454; 315/3.5

[56] References Cited

U.S. PATENT DOCUMENTS

| | | | |
|---|---|---|---|
| 2,947,905 | 8/1960 | Pierce | 313/447 X |
| 3,484,645 | 12/1969 | Drees | 313/348 |
| 3,558,967 | 1/1971 | Miriam | 315/3.5 |
| 3,818,260 | 6/1974 | Elfe, Jr. et al. | 313/348 |
| 3,859,552 | 1/1975 | Hechtel | 313/348 |
| 3,967,150 | 6/1976 | Lien et al. | 313/348 |
| 4,023,061 | 5/1977 | Berwick et al. | 313/348 |
| 4,096,406 | 6/1978 | Miram et al. | 313/348 |

*Primary Examiner*—Saxfield Chatmon, Jr.
*Attorney, Agent, or Firm*—Stanley Z. Cole; Keiichi Nishimura

[57] ABSTRACT

A gun for a linear-beam electron tube has a control grid for modulating the beam current which consists of an array of conductive web elements whose spacing from each other is much larger than their spacing from the concave emissive surface of the cathode. It was found that when this condition is met the grid can be operated at cathode potential while beam current is being drawn without distorting the electric accelerating field enough to ruin the focusing of the beam. Thus, when the grid is used to pulse the beam current on and off, it can have zero bias in the "on" condition, whereby the pulse modulator can be greatly simplified.

4 Claims, 5 Drawing Figures

FIG. 1
PRIOR ART
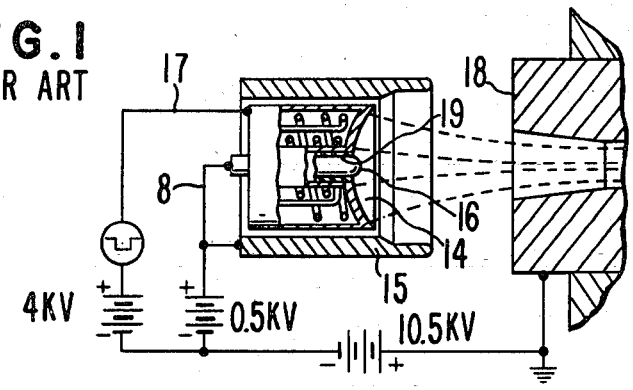
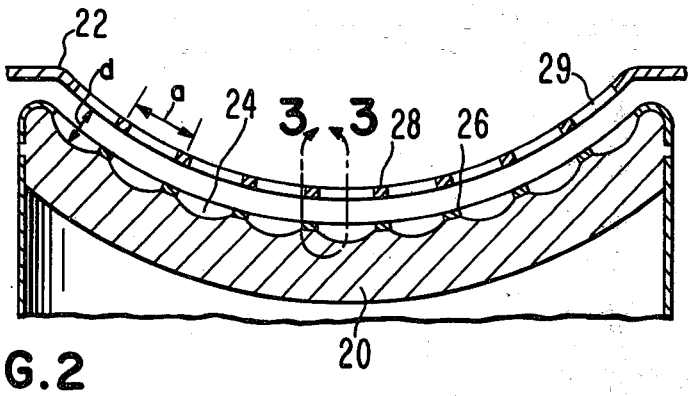
FIG. 2
PRIOR ART
FIG. 3
PRIOR ART
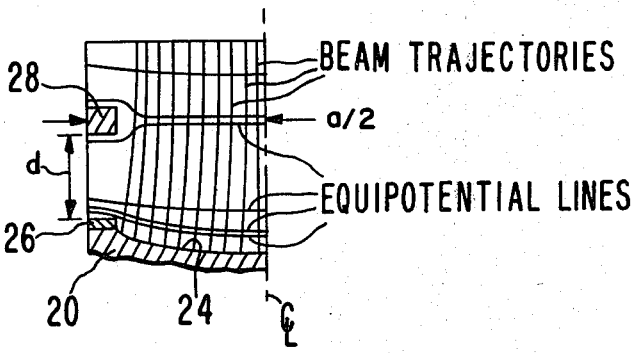

ZERO-BIAS GRIDDED GUN

This is a division of application Ser. No. 927,087 filed July 24, 1978, now U.S. Pat. No. 4,227,116.

FIELD OF THE INVENTION

The invention relates to electron guns widely used in linear-beam microwave tubes such as klystrons and travelling-wave tubes. Such guns typically have a concave emitting cathode surface from which a converging stream of electrons is drawn by an accelerating anode in front of the cathode. The converged beam passes through a hole in the anode to enter the tube's interaction region. Such guns are often made with a control grid covering the emissive surface and spaced slightly from it. The control grid is usually driven by a rectangular-wave pulser to produce a pulsed electron beam. The grid is pulsed negative with respect to the cathode to turn the beam off and intermittently pulsed somewhat positive to turn the beam on for a short time.

PRIOR ART

Convergent electron guns for linear-beam tubes typically have a focussing electrode surrounding the emitting cathode to shape the electric fields for proper convergence of the beam. It has been known to insulate this focussing electrode from the cathode and use it as a control electrode to modulate the beam. The cut-off amplification factor for this control electrode is only 1.5 to 2.0 maximum. Hence, the modulating voltage to pulse the beam completely off must be at least half the value of the beam accelerating voltage, making the cost, size and power consumption of the modulator unreasonable.

U.S. Pat. No. 3,183,402 issued May 11, 1965 to L. T. Zitelli illustrates an improvement to this control electrode. FIG. 1 is a schematic diagram of Zitelli's gun. Concave cathode 14 is surrounded by the hollow focus electrode 15. In addition, a hole 19 through the center of cathode 14 contains an insulated central probe electrode 16 whose face projects beyond the surface of cathode 14. The electron beam drawn from cathode 14 by accelerating anode 18 is thus slightly hollow because probe 16 non-emitting. Probe 16 and focus electrode 15 are tied together by a conductor 8. A pulsed modulating voltage may be applied to them to turn the beam on and off. Alternatively, as shown in FIG. 1 which corresponds to FIG. 3 of the Zitelli patent, the control electrodes may be connected to a small positive bias voltage as shown and the cathode 14 is then pulsed negative via conductor 17 to turn the beam on. The addition of the center post electrode raised the cut-off amplification factor to about 3.0, thus making a modest improvement in the demands on the modulator. The control electrodes of this prior art cannot truly be classed as grids because they do not cover the surface of the cathode to produce a high amplification factor. Rather, they are removed from the electron beam and must exert their influence on the electric field from a distance, thus the low amplification factor.

Actual grids covering the cathode surface and situated in the electron stream have been used in linear-beam tubes where the duty cycle, that is the ratio of beam on-time to beam off-time, is small. U.S. Pat. No. 3,843,902 issued Oct. 22, 1974 to George V. Miram and Gerhard B. Kuehne illustrates an advanced prior-art grid. FIG. 2, copied from the above patent, illustrates the general range of geometries used in the prior art. Here the generally concave cathode 20 is substantially covered by a grid 22 spaced a distance d from its emissive surface 24. In this particular invention emissive surface 24 is composed of a large number of small concave depressions with non-emissive grid elements 26 covering the spaces between them. The conductive web elements 28 of control grid 22 are aligned with the non-emissive "shadow" grid elements 26 so that the small beamlets of electrons are focused through the apertures 29 of grid 22 and miss the conductive web elements 28. Since grid 22 is run positive with respect to cathode 20 when beam current is being drawn, any interception of electrons by web elements 28 causes undesirable secondary emission as well as heating of the grid and consequently thermionic emission from it. Such a grid can provide quite a high amplification factor, of the order of 100 or more depending on the ratio of grid element spacing a to grid-to-cathode spacing d. FIG. 2 illustrates a typical state-of-the-art geometry where a is 1.5 to 2.0 times d. It was known from the prior art of receiving-type grid-controlled radio tubes that the grid element spacing could be made large so that when the grid operated at zero bias useful currents could be drawn to the anode. However, it was universally believed in the linear beam tube art that unbearable distortions of the trajectories of the electrons in the beam would result unless the grid were operated at a potential equal to the potential that would occur in space at the position of the grid if the grid were not there. FIG. 3, taken also from U.S. Pat. No. 3,843,902 illustrates the electron trajectories and the equipotential surfaces calculated for a section of the gun of FIG. 2. The uniformity of the equipotentials in the grid aperture inside element 22 shows that the grid potential was indeed very close to the space potential.

SUMMARY OF THE INVENTION

An object of the invention is to provide a convergent linear-beam gun with a control grid of fairly high amplification factor which can be operated at a potential no more positive than the cathode. A further object is to provide a gun whose current can be switched on and off with a low pulse voltage. A further object is to provide a gun with a grid which requires no voltage bias with respect to the cathode, thereby simplifying the modulator. A further object is to provide a gun which can be operated at very high duty cycles without excess heating of the grid.

These objects have been achieved by a novel configuration of the grid elements. The inventors found the surprising results that, when the spacing between grid web elements is many times the spacing between the grid elements and the cathode surface, the grid can then be run at cathode potential while drawing current from the cathode without distorting the electron trajectories so seriously that the tube would be unusable. This result was not derivable from the widely spaced grids of the receiving-tube art, because in that art the shape of the electron trajectories after passing through the grid was not highly critical as it is in the linear-beam tube art.

BRIEF DISCUSSION OF THE DRAWINGS

FIG. 1 is a sketch of the prior arrangement of non-intercepting beam control electrodes.

FIG. 2 is a sketch of a prior-art gun in which the grid was operated at a potential positive with respect to the cathode.

FIG. 3 shows the electron trajectories and equipotential lines of the gun of FIG. 2.

DESCRIPTION OF THE PREFERRED EMBODIMENTS

Figure 4:
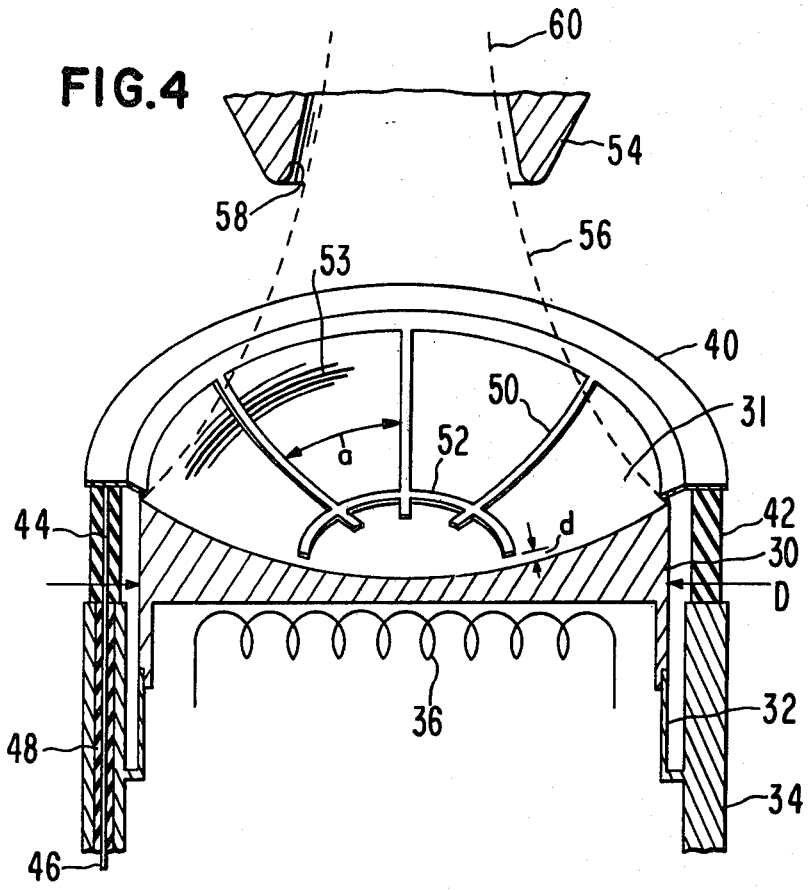
FIG. 4 is a schematic partial section of a gun according to the present invention.

FIG. 4 is a partly perspective, partly sectional sketch of a gun embodying the invention. Thermionic cathode 30 has a spherically concave emissive surface 31, such as an oxide coated surface. Cathode 30 is supported by a thin metallic cyclinder 32 of low thermal conductivity, from a rigid support member 34 which latter is eventually mounted on a vacuum envelope and cathode voltage insulator (now shown). A heater 36, shown schematically, raises cathode 30 to a thermionic emitting temperature. A grid structure 40 is supported on a grid insulator 42 from mounting member 34. A conductive grid lead 44 traverses through a hole in insulator 42 to connect with external grid lead 46 insulated from supporting member 34 by insulating member 48. Grid 40 comprises radial and azimuthal web members 50, 52 which are disposed a small distance d in front of emissive surface 31. Apertures 53 in grid 40 between web members 50, 52 have transverse dimensions a which are much larger than the grid-to-cathode spacing d. A hollow anode 54 may be included as part of the electron gun or alternatively may be built and regarded as a separate element. Anode 54, when operated at a high positive voltage with respect to cathode 30, draws a converging stream of electrons 56 which pass through an aperture 58 in anode 54 to form the required linear-beam outline 60. The novelty of the gun lies in the combination of the method of operation and the novel geometric arrangement which makes this operation possible.

Figure 5:
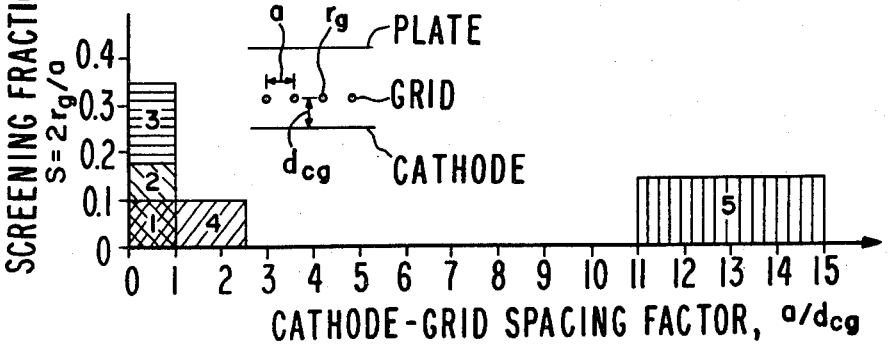
FIG. 5 shows the range of geometries of typical prior-art guns compared to the geometries of successful guns embodying the invention.

FIG. 5 illustrates the range of geometries involved compared to the prior art. The left-hand side of FIG. 5 is taken from the well-known book "Vacuum Tubes" by K. R. Spangenberg, McGraw-Hill, New York, 1948. It illustrates the range of geometries covered by various approximate formulas used in the prior art for calculating the amplification factor. The variables are the screening fraction S, which is just the fraction of the cathode shaded by the diameters of the assumed round parallel wires, and the cathode-grid spacing factor, which is the ratio of the spacing between grid wires to the spacing from grid wires to cathode. The different cross-hatchings represent the regions for which various approximate formulas apply. Note that cathode-grid spacing factors below about 2.5 are the range considered by this comprehensive prior-art review. At the right-hand side of FIG. 5 the cross-hatched region 5 illustrates the range of geometries which have been found workable in the present invention with zero grid bias. It is likely that a more extensive range of cathode-grid spacing factors may be useful, including ratios around 10 and perhaps as low as 5. For ratios above 15 the amplification factor becomes quite low. For a gun with microperveance 1.0 the amplification factor was a useful value of 9.

Another factor which affects the perfection of focus of the beam is the ratio of the cathode-grid spacing d to the overall diameter D of the cathode. The inventors have found that good beam optics can be maintained when d/D lies between 0.01 and 0.04.

It will be obvious to those skilled in the art that if the control grid is constrained to remain at cathode potential during the time beam current is drawn, that increasing the amplification factor by increasing the screening fraction or decreasing the cathode-grid spacing factor will inevitably decrease the perveance of the gun. Thus a compromise between amplification factor and perveance must always be made. Other limitations are that the cathode-grid spacing factor a/d must be quite large and the ratio d/D must be small to avoid undue distortion of the electron trajectories. When these conditions are fulfilled, one can use the desirable method of modulation in which the grid is at zero bias during the current pulse, thus eliminating electron bombardment of the grid with consequent over-heating and secondary emission, and also simplifying pulse modulator. The invention thus comprises this desirable method of modulation.

It will be obvious to those skilled in the art that many embodiments may be made within the scope of the invention, which is intended to be limited only by the following claims and their legal equivalents.

We claim:

1. A method of modulating a linear-beam of electrons, comprising drawing said beam from a concave electron-emissive cathode surface by an apertured anode at a potential positive to said cathode, applying a modulating voltage wave form to an electron-permeable grid of conductive elements covering said concave emissive surface and supported insulated from said cathode, the most positive value of said modulating voltage wave form being no more positive than said cathode.

2. The method of claim 1 wherein said modulating voltage wave form is a series of rectangular pulses.

3. The method of claim 1 or 2 wherein said steps of drawing said beam and applying a modulating voltage wave form are effected without concurrently applying to any element immediately adjacent to said cathode surface or to said grid a potential positive to said cathode.

4. The method of claim 1 wherein the spacing between said conductive elements is at least five times the spacing between said grid and said emissive surface.

* * * * *